US006705477B1

(12) United States Patent
Narkis et al.

(10) Patent No.: US 6,705,477 B1
(45) Date of Patent: Mar. 16, 2004

(54) MULTI-FUNCTION SLOT CONFIGURATION FOR MOUNTING DIFFERENTLY CONFIGURED SHELF ACCESSORIES TO A SHELF

(75) Inventors: Lawrence A. Narkis, Fort Atkinson, WI (US); Jerry P. Steinbrecher, Milton, WI (US); William H. Punzel, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 09/791,087

(22) Filed: Feb. 22, 2001

(51) Int. Cl.[7] ..... A47B 57/58
(52) U.S. Cl. ..... 211/153
(58) Field of Search ..... 211/153; D6/396, D6/449, 458, 462, 477, 478, 479

(56) References Cited

U.S. PATENT DOCUMENTS

| | | | | |
|---|---|---|---|---|
| 3,160,282 A | 12/1964 | Gunn | ..... | 211/184 |
| 3,497,081 A | 2/1970 | Field | ..... | 211/184 |
| 3,669,278 A | 6/1972 | Heroy | ..... | 211/184 |
| 3,905,484 A | 9/1975 | Dean et al. | ..... | 211/184 |
| 4,759,449 A | 7/1988 | Gold | ..... | 211/184 X |
| 5,441,709 A | 8/1995 | Berry, Jr. | ..... | 211/184 X |
| 6,098,821 A * | 8/2000 | Dube et al. | ..... | 211/184 |

* cited by examiner

*Primary Examiner*—Daniel P. Stodola
*Assistant Examiner*—Erica B Hawis
(74) *Attorney, Agent, or Firm*—Boyle, Fredrickson, Newholm, Stein & Gratz, S.C.

(57) ABSTRACT

A shelf includes a slot or opening configuration for use in mounting different types of shelf accessories to the shelf. The slot or opening configuration includes an enlarged primary or central section and a pair of secondary or end sections extending in opposite directions from the primary section. The primary section of the opening receives an axially-extending mounting member associated with a shelf accessory, such as a fastener for mounting a bin divider or the mounting portion of a rod-type shelf divider. The secondary sections of the opening have a width less than the diameter of the fastener or mounting portion, so as to maintain the fastener or mounting portion within the primary area of the opening. A shelf accessory with a tab-type mounting arrangement, such as an upright shelf divider, is mounted to the shelf by positioning the tabs within the aligned secondary sections of the opening, and the tabs extend into and across the primary section. The slot or opening configuration is formed in place of conventional separate elongated slots and circular openings, which creates manufacturing and inventory efficiencies in reducing the overall numbers of different shelves to be manufactured and carried in inventory.

11 Claims, 5 Drawing Sheets

MULTI-FUNCTION SLOT CONFIGURATION FOR MOUNTING DIFFERENTLY CONFIGURED SHELF ACCESSORIES TO A SHELF

BACKGROUND AND SUMMARY OF THE INVENTION

This invention relates to a shelf, and more particularly to an arrangement for mounting differently configured shelf accessories to a shelf.

It is known to provide a shelf with rows of aligned slots, which are adapted to receive mounting tabs formed on a shelf divider for mounting the shelf divider to the shelf. In a typical embodiment, two rows of slots are formed in the shelf, and the shelf divider includes a pair of mounting tabs. The tabs can be engaged with selected ones of the slots, so as to enable the divider to be mounted in any desired location along the length of the shelf.

It is also known to form a series of aligned holes in a shelf for use in mounting other types of shelf accessories to the shelf. The aligned holes are adapted to receive fasteners for mounting shelving accessories, such as bin dividers, to the shelf in various locations along the length of the shelf. The holes can also be used to receive rod-type shelf dividers, which are used in certain applications.

These types of shelf accessory mounting arrangements function satisfactorily to mount shelf accessories to shelves. However, the different types of shelf accessory mounting configurations, i.e. slot-type and hole-type, have been manufactured, ordered and inventoried separately from each other, which requires different manufacturing, ordering and inventory operations. This can be burdensome and inefficient for manufacturers, distributors and customers of shelving, especially when large volumes are involved.

It is an object of the present invention to provide a shelf having a slot or opening configuration which is adapted to mount shelving accessories with different mounting configurations. It is a further object of the invention to provide a slot or opening configuration for a shelf which is shaped so as to provide engagement with two of the most commonly employed types of mounting arrangements for shelving accessories. A further object of the invention is to provide such a slot or opening configuration which can be formed in a shelf without detracting from the overall appearance or operability of the shelf. Yet another object of the invention is to provide such a slot or opening configuration which can be formed with tooling similar to that commonly employed for forming commonly shaped shelf slots or openings. Yet another object of the invention is to provide such a slot or opening configuration which is relatively simple in its shape and construction, yet which provides highly satisfactory operation in mounting shelf accessories having differently configured mounting structure to the shelf.

In accordance with the invention, a shelf includes a support surface and at least one slot or opening formed in the support surface. The opening includes a primary or central area and one or more secondary or end areas extending from the primary area. The primary area has a transverse dimension greater than the transverse dimension of each secondary area. In a preferred form, a pair of secondary areas extend in opposite directions from the primary area. A first shelf accessory includes a tab-type mounting arrangement that includes at least one downwardly extending tab member. The first shelf accessory is mounted to the shelf by positioning the tab member within the opening such that the tab member is received within at least one of the secondary areas of the opening. In one form, the tab member and the opening are configured such that a portion of the tab member resides in a first one of the secondary areas, and the tab member extends across the primary area of the opening and into a second one of the secondary areas of the opening. The tab member has a width slightly less than that of the secondary areas of the opening, such that engagement of the tab member within the opening functions to mount the first shelf accessory to the shelf and to maintain the first shelf accessory in an upright attitude.

A second shelf accessory includes an axially-extending mounting member. In one form, the axially-extending mounting member may be a fastener separate from the shelf accessory and adapted to engage an opening in mounting structure, such as a bottom flange, associated with the second shelf accessory. In another form, the second shelf accessory may be a rod-type shelf divider having an axially extending mounting portion. In either case, the axially-extending mounting member is mounted to the shelf by placing the axially extending mounting member into and through the primary area of the opening. The one or more secondary areas of the opening have a transverse dimension less than that of the axially-extending mounting member, so as to maintain the axially-extending mounting member within the primary area of the opening.

In one form, the opening defines a pair of secondary areas that extend in opposite directions from the primary area and are aligned with each other. The secondary areas of the opening define facing inner ends between which the primary opening is located. The primary opening may be defined by a pair of oppositely directed edges extending between and interconnecting the facing inner ends of the secondary areas.

The shelf may be formed with a series of similarly configured openings extending in one or more rows along the length of the shelf. With this construction, the shelf accessories can be mounted to the shelf at various locations along the length of the shelf.

The invention also contemplates a method of mounting shelf accessories having differently configured mounting arrangements to a shelf, as well as an improvement in an opening formed in a shelf, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
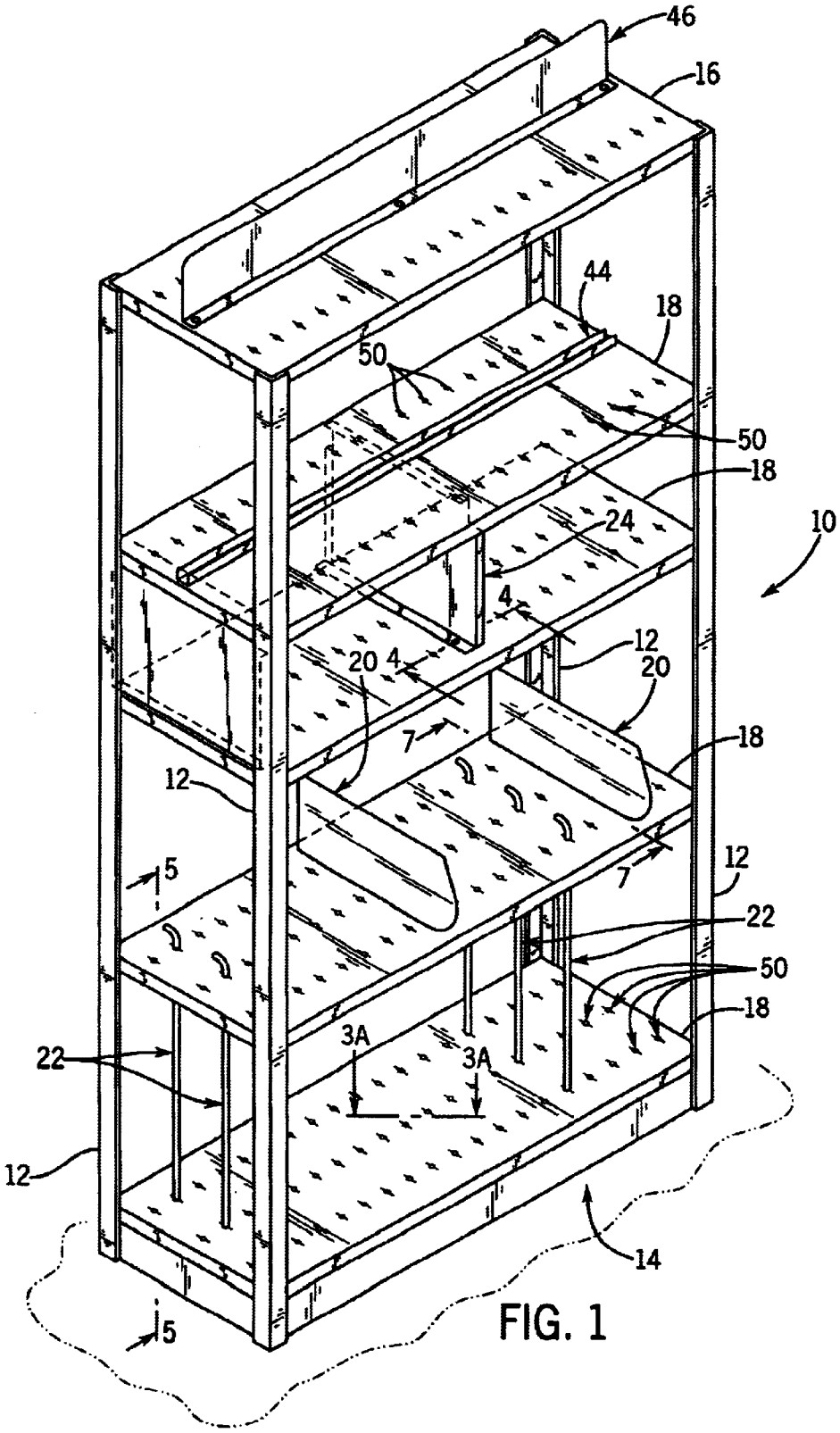
FIG. 1 is an isometric view of shelf assembly having shelves incorporating the multi-function slot configuration of the present invention for mounting shelf accessories with differently configured mounting structures.
Figure 2:
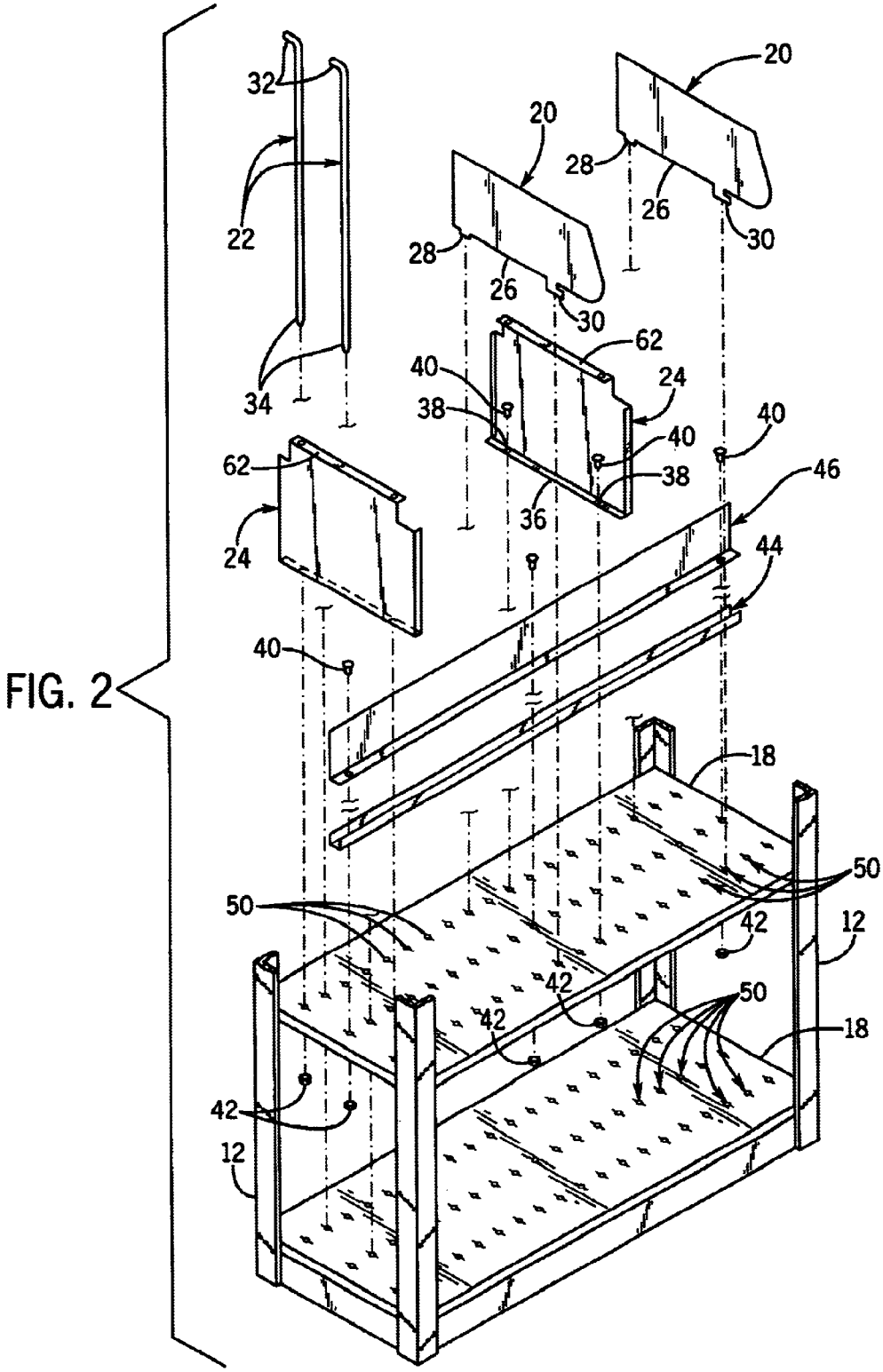
FIG. 2 is a partial exploded isometric view showing a portion of the shelf assembly of FIG. 1 and different shelf accessories adapted for engagement with the shelves.

Referring to FIGS. 1 and 2, a shelf assembly 10 constructed according to the invention generally includes a series of corner posts 12 extending upwardly from a base 14 and interconnected at their upper ends with a top panel 16. A shelf 18 is mounted above base 14, and a series of similarly configured shelves 18 are engaged with corner posts 12. The general construction of shelf assembly 10 is known in the art, and shelf assemblies of this type are available from Spacesaver Corporation of Fort Atkinson, Wisconsin, designated as four-post or case-type shelving. In a manner as is known, shelves 18 can be engaged with corner posts 12 at various locations, to vary the shelf height according to user requirements.

A variety of shelf accessories are adapted for use in combination with shelf assembly 10. Such accessories include upright file dividers 20, rod-type file dividers 22, and bin dividers 24. Again, these types of shelf accessories are common and well-known, and are representative of a variety of types of shelf accessories which can be used in combination with shelf assembly 10.

In a known manner, each upright file divider 20 includes a lower edge 26 engageable with the upwardly facing surface of shelf 18, a depending rear retainer tab 28 and a depending front locking tab 30. Also in a known manner, each rod-type file divider 22 includes a bent upper retainer section 32 and a lower, axially extending mounting portion 34, which is coaxial with the area of rod-type file divider 22 between retainer section 32 and mounting portion 34. Each bin divider 24 includes a lower mounting flange 36 within which a pair of openings 38 are formed. A pair of fasteners 40, such as threaded screws, are adapted to extend through openings 38, and a pair of nuts 42 are engageable with fasteners 40. Other shelf accessories are engageable with shelves 18, such as a center support 44 adapted to secure sliding supports or the like, and/or a double entry center stop 46, which are engageable with a shelf 18 by fasteners such as 40 and nuts such as 42. Center support 44 and double entry center stop 46 are representative of other types of shelf accessories which can be mounted to shelf assembly 10.

As shown in FIGS. 1 and 2, each shelf 18 includes a series of slots or openings 50 for use in mounting shelf accessories, such as upright file dividers 20, rod-type file dividers 22, bin dividers 24, center support 44 and center stop 46, to each shelf 18. As shown, openings 50 are formed in aligned rows in the upwardly facing support surface of each shelf 18, and openings 50 in each row are identically configured. It is understood, however, that various arrangements of openings 50 are contemplated as being within the scope of the present invention, and that openings 50 need not necessarily be arranged in rows on shelves 18 and each opening need not have the configuration of openings 50. For example, openings 50 may be used in combination with conventional slot-type or circular-type openings, or may be formed such that openings 50 are arranged in one row but not all rows of openings in shelf 18. Further, the openings in shelves 18 may be formed such that only certain ones of the openings have the configuration of openings 50. In a manner to be explained, openings 50 are configured so as to accommodate the different mounting arrangements for the shelf accessories described above, for mounting different shelf accessories to shelf 18 using the same opening structure.

Figure 3A:
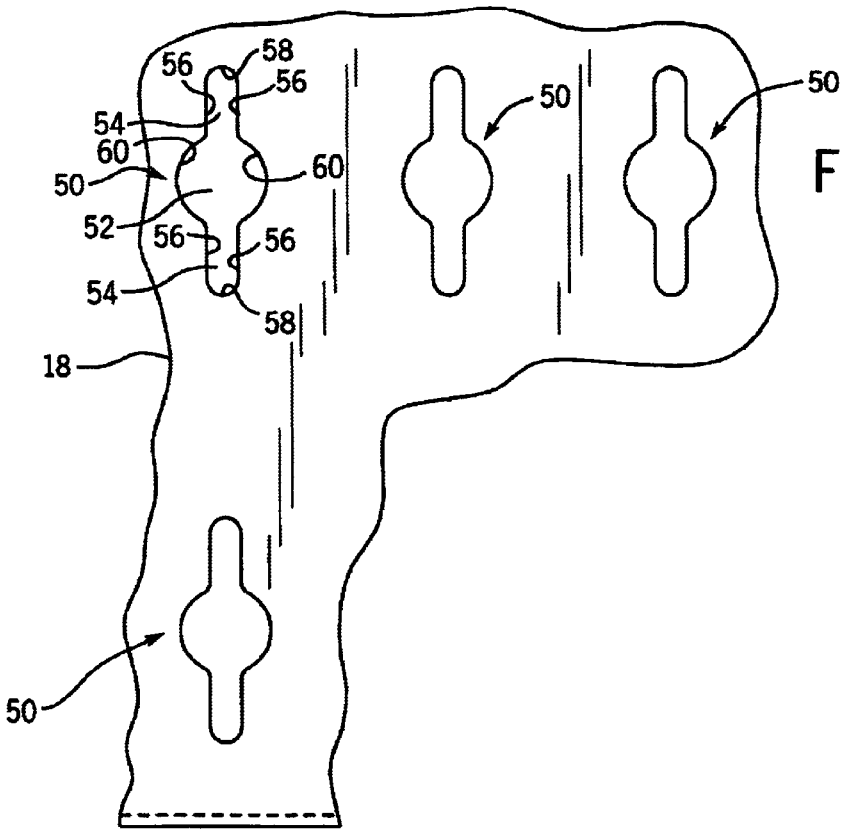
FIGS. 3*a* and 3*b* are partial plan views illustrating the configuration of openings formed in the shelves incorporated in the shelf assembly of FIGS. 1 and 2.
Figure 3B:
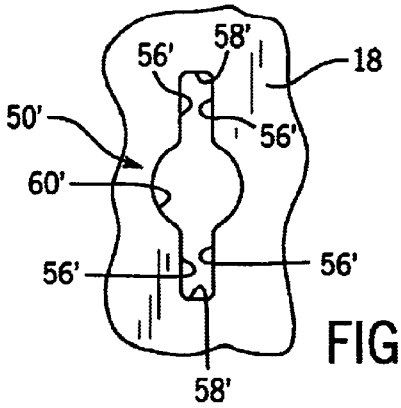

FIGS. 3A and 3B illustrate the configuration of openings 50. Referring to FIG. 3A, each opening 50 includes a primary or central area or section 52 and a pair of secondary or end areas or sections 54 extending in opposite directions from primary or central area or section 52.

Each secondary area 54 is defined by a pair of parallel linear side edges 56 with an arcuate end edge 58 extending between and interconnecting the outer ends of side edges 56. The inner ends of secondary areas 54 face each other, and primary area 52 is located between and interconnects the facing inner ends of secondary areas 54. Primary area 52 is defined by a pair of oppositely directed arcuate edges 60, each of which extends between one set of aligned secondary area side edges 56. With this construction, each secondary area 54 has a transverse dimension less than that of primary area 52.

FIG. 3*b* illustrates an alternative slot or opening 50', which has a configuration like that of slot or opening 50 with the exception that end edge 58', which extends between side edges 56', is squared off such that end edge 58' extends perpendicularly to side edges 56' throughout a majority of the length of end edge 58'. It has been found that the configuration of slots or openings 50 provides somewhat less stress on the tooling utilized to form opening 50 than is the case with opening 50'. However, either opening configuration has been found to be satisfactory in operation.

Opening 50 is shown with two secondary areas 54 extending in opposite directions from primary area 52. It should be understood, however, that opening 50 could be formed so that primary area 52 is closed at one end and only a single one of secondary areas 54 extends from primary area 52. In forming the opening in this manner, secondary area 54 would have a length slightly greater than that illustrated with respect to secondary areas 54 as shown.

In operation, openings 50 function to mount shelf accessories to shelves 18 in the following manner.

Figure 4:
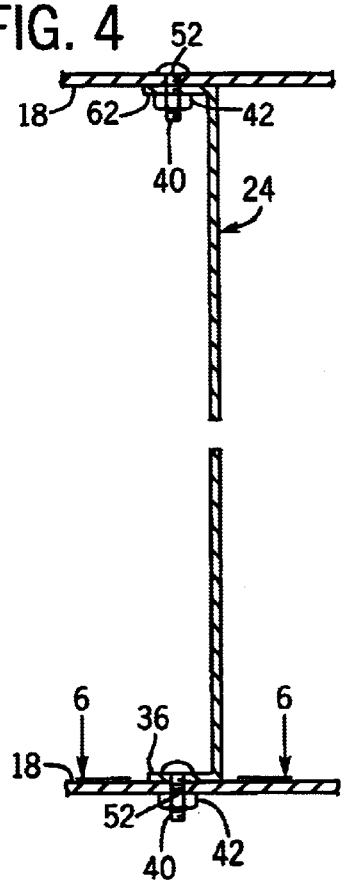
FIG. 4 is a partial section view taken along line 4—4 of FIG. 1, illustrating the manner in which a shelf accessory with a fastener-type mounting arrangement is secured to the shelf.
Figure 6:
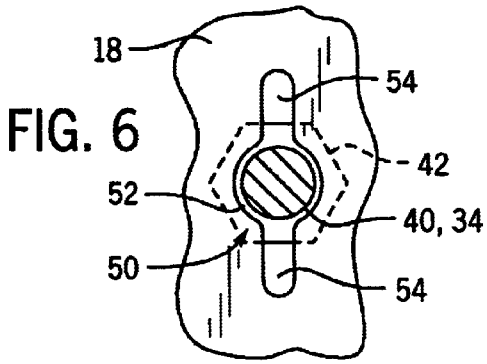
FIG. 6 is a partial section view taken along line 6—6, with reference to both FIGS. 4 and 5.

Referring to FIG. 4, bin divider 24 is placed between a pair of shelves 18 such that the lower mounting flange 36 of bin divider 24 engages the upwardly facing support surface of a lower one of shelves 18 and an upper mounting flange, shown at 62, is positioned adjacent the downwardly facing surface of an upper one of shelves 18. Flange openings 38 are positioned in alignment with selected openings 50 in lower shelf 18, according to the desired position of bin divider 24. Similar openings in upper mounting flange 62 are positioned in alignment with matching ones of openings 50 formed in upper shelf 18. Screws 40 are then inserted through the flange openings, such as 38, and nuts 42 are engaged with the threaded shanks of screws 40. Referring to FIG. 6, primary area 52 of opening 50 is sized and shaped so as to receive the threaded shank of screw 40, and secondary areas 54 have a transverse dimension less than that of the shank of screw 40 so as to maintain screw 40 within primary area 52.

Figure 5:
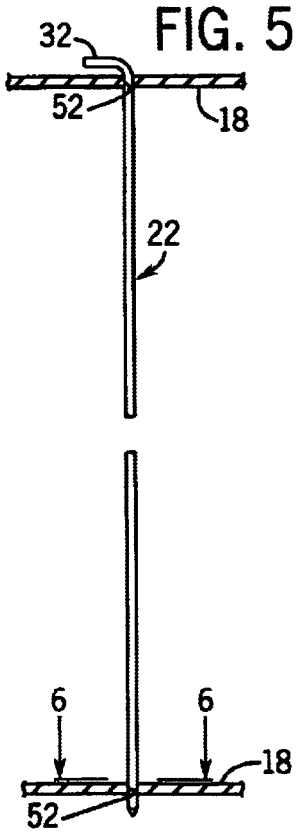
FIG. 5 is a partial section view taken along line 5—5 of FIG. 1, showing the manner in which a rod-type shelf divider is mounted to the shelves.

Referring to FIG. 5, rod-type shelf dividers 22 are engaged with upper and lower shelves 18 in a similar manner. The upper portion 32 of rod-type shelf divider 22 extends through opening 50 formed in the upper shelf 18, and the lower mounting portion 34 of rod-type shelf divider 22 is received within opening 50 in the lower shelf 18. Rodtype shelf divider 22 has a diameter similar to that of the threaded shank of screw 40 with respect to FIGS. 4 and 6, such that the diameter of rod-type shelf divider 22 is greater than the width of opening secondary areas 54. In this manner, the mounting areas of rod-type shelf divider 22, such as mounting portion 34, are maintained within the primary areas 52 of openings 50, to fix rod-type shelf dividers 22 in position relative to shelves 18.

Figure 7:
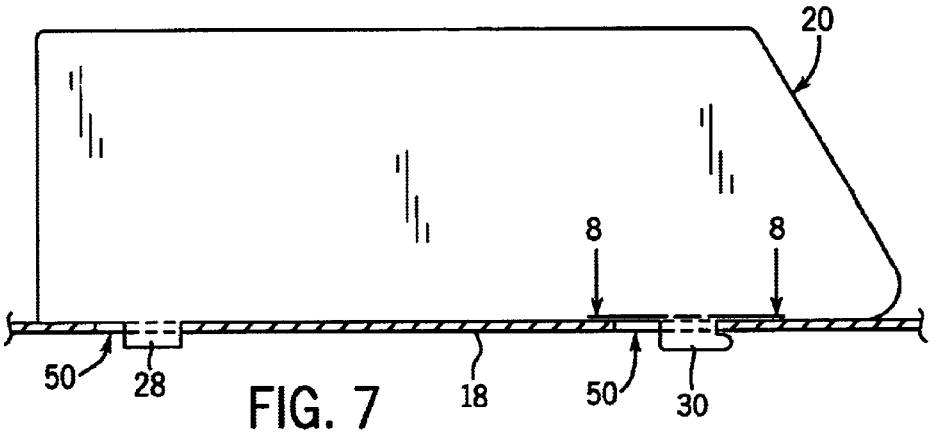
FIG. 7 is a partial section view taken along line 7—7 of FIG. 1, showing the manner in which a shelf accessory with a tab-type mounting arrangement is mounted to the shelf.
Figure 8:
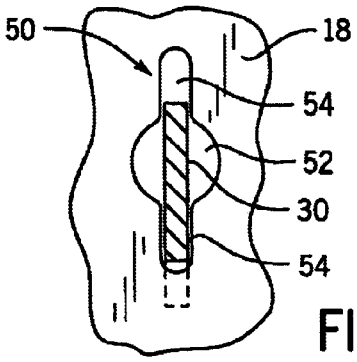
FIG. 8 is a partial section view taken along line 8—8 of FIG. 7.

As shown in FIGS. 7 and 8, upright shelf divider 20 is engageable with a lower one of shelves 18 by positioning rear retainer tab 28 and front locking tab 30 in a selected aligned pair of openings 50, and at desired location along the length of shelf 18. Tabs 28, 30 are positioned in openings 50 such that tabs 28, 30 extend into both of secondary areas 54 and through primary area 52. Divider 20 is then pulled forwardly in a conventional manner, such that the forward locking ear provided on locking tab 30 is positioned below the area of shelf 18 located forwardly of end edge 58 of the forward one of secondary areas 54, to lock shelf divider 20 to shelf 18 in a known manner. As shown in FIG. 8, a portion of tab 30 resides within the forward one of secondary areas 54, and tab 30 extends across primary opening area 52 and into the rear one of secondary opening areas 54. In this manner, tabs 28, 30 are positioned within the opening secondary areas 54, and the tolerances between the side surfaces of tabs 28, 30 and the side edges 56 of secondary areas 54 are such as to maintain shelf divider 20 in an upright position, in a manner as is known.

It should be understood that one of secondary areas 54 could be lengthened and the other secondary area 54 could be eliminated, and that tabs 28, 30 could be mounted to shelf 18 in the same manner as described previously while providing adequate support for upright shelf divider 20. The lengthening of one of secondary areas 54 provides sufficient engagement with the side surfaces of tabs 28, 30 to support upright shelf divider 20, and the rear end portions of tabs 28, 30 simply extend into primary area 52 or are wholly received within the elongated one of secondary areas 54.

It can thus be appreciated that the unique configuration of openings 50 enables shelving accessories with different types of mounting arrangements to be engaged with shelf 18, without modification to the mounting structure of the shelf accessory. Openings 50 are formed in place of conventional slot-type and hole-type openings, which are typically employed to mount shelving accessories with different types of mounting arrangements. The shelf manufacturer can thus reduce the number of tools required to form shelf openings, and can also reduce the number of differently configured products required to be manufactured. The distributors and users of shelves 18 can stock a lesser number of shelves, and different shelf accessories can be employed without the need for changing out the shelves to mount the desired shelf accessories.

Openings 50 are formed in a conventional manner, typically in a stamping process, when shelves 18 are being manufactured.

While shelves 18 are illustrated as being of the formed sheet metal type, it is understood that the configuration of openings 50 could be employed in any type of shelf made of any satisfactory type of shelf material so as to accommodate different mounting arrangements for different types of shelf accessories.

Various alternatives and embodiments are contemplated as being within the scope of the following claims particularly pointing out and distinctly claiming the subject matter regarded as the invention.

We claim:

1. A shelf system, comprising:

a support member having a support surface, wherein the support surface includes at least one row of aligned openings, wherein each opening includes a central area and a pair of aligned end areas extending in opposite directions from the central area, wherein the central area defines a transverse dimension greater than that of the aligned end areas;

a first shelf accessory having a tab-type mounting arrangement including a depending tab member; and a second shelf accessory having an axially-extending mounting member;

wherein the first shelf accessory and the second shelf accessory are simultaneously mounted to the support member;

wherein the first shelf accessory is mounted to the support member by positioning the tab member of the first shelf accessory within the central area and at least one of the end areas of a first one of the openings, wherein the first shelf accessory is configured such that, when the first shelf accessory is mounted to the support member, the tab member occupies a portion of the central area of the first opening located in alignment with the end areas of the first opening and the remainder of the central area of the first opening is unoccupied; and wherein the second shelf accessory is mounted to the support member by placing the axially extending mounting member of the second shelf accessory through the central area of a second one of the openings, wherein the end areas of the second opening and the axially extending mounting member are sized so as to maintain the axially extending mounting member within the central area of the second opening without engagement of the axially extending mounting member within the end areas of the second opening, and wherein the second shelf accessory is configured such that, when the second shelf accessory is mounted to the support member, the axially extending mounting member occupies the central area of the second opening and the end areas of the second opening are unoccupied.

2. The shelf system of claim 1, wherein the central area of each opening comprises a pair of arcuate edges extending in opposite directions from facing inner portions of the pair of aligned end areas.

3. The shelf system of claim 1, wherein the tab member is configured such that a first portion of the tab member is received within a first one of the pair of aligned end areas of the first opening and a second portion of the tab member is positioned within a second one of the aligned end areas of the first opening.

4. The shelf system of claim 3, wherein the tab member further includes an intermediate portion located between the first and second portions and disposed within the central area of the first opening.

5. The shelf system of claim 1, wherein the second shelf accessory comprises an upstanding shelf divider having a lower end defining a mounting structure, and wherein the axially-extending mounting member comprises a fastener engageable with the mounting structure and received within the central area of the second opening.

6. The shelf system of claim 1, wherein the second shelf accessory comprises a rod member having an axially extending mounting portion adapted to be received within the central area of the second opening.

7. A shelf system, comprising:

a shelf member including a support surface having a series of openings, wherein each opening includes a first area and a second area extending from the first area, wherein the first area defines a transverse dimension greater than the second area;

a first shelf accessory including tab-type mounting structure having at least one downwardly extending tab; and a second shelf accessory including a mounting arrangement having an axially extending mounting member;

wherein the first and second shelf accessories are simultaneously mounted to the shelf member;

wherein the first shelf accessory is mounted to the shelf member by engaging the downwardly extending tab of the first shelf accessory within the first area of a first one of the openings and within the second area of the first opening, wherein the first shelf accessory and the tab are configured such that the tab is received within the second area of the first opening and occupies a portion of the first area of the first opening in alignment with the second area of the first opening, wherein portions of the first area of the first opening located outwardly of the tab are unoccupied when the first shelf accessory is mounted to the shelf member; and wherein the second shelf accessory is mounted to the shelf member by engaging the axially extending mounting member of the second shelf accessory within the first area of a second one of the openings, wherein the axially extending member is configured to occupy the first area of the second opening and wherein the second area of the second opening is sized to prevent the axially-extending mounting member from engagement within the second area of the second opening.

8. The shelf system of claim 7, wherein each opening includes a pair of second areas extending from the first area, wherein the pair of second areas are aligned with each other.

9. The shelf system of claim 8, wherein the downwardly extending tab of the first shelf accessory is received within portions of both a first and a second one of the pair of second areas of the first opening and extends across the first area of the first opening.

10. The shelf system of claim 7, wherein the axially-extending mounting member of the second shelf accessory comprises a fastener which extends through the first area of the second opening into engagement with the mounting structure associated with the second shelf accessory and engaged with the shelf member.

11. The shelf system of claim 7, wherein the axially-extending mounting member of the second shelf accessory comprises an axially-extending mounting portion associated with a rod-type shelf divider.

* * * * *